US009166288B2

(12) United States Patent
Hwang et al.

(10) Patent No.: US 9,166,288 B2
(45) Date of Patent: Oct. 20, 2015

(54) BEAM STEERING ANTENNA STRUCTURE

(71) Applicant: National Chiao Tung University, Hsinchu (TW)

(72) Inventors: Ruey-Bing Hwang, Hsinchu (TW); Su-Che Yang, Hsinchu (TW); Hsien-Tung Huang, Hsinchu (TW)

(73) Assignee: National Chiao Tung University, Hsinchu (TW)

( * ) Notice: Subject to any disclaimer, the term of this patent is extended or adjusted under 35 U.S.C. 154(b) by 470 days.

(21) Appl. No.: 13/659,130

(22) Filed: Oct. 24, 2012

(65) Prior Publication Data

US 2013/0234889 A1 Sep. 12, 2013

(30) Foreign Application Priority Data

Mar. 8, 2012 (TW) ..... 101107848 A

(51) Int. Cl.
*H01Q 3/24* (2006.01)
*H01Q 21/20* (2006.01)

(52) U.S. Cl.
CPC ..... *H01Q 3/242* (2013.01); *H01Q 21/20* (2013.01)

(58) Field of Classification Search
CPC ..... H01Q 3/24; H01Q 3/26; H01Q 3/40
USPC ..... 342/81, 157, 368, 373, 374; 343/700 MS, 745, 909
See application file for complete search history.

(56) References Cited

U.S. PATENT DOCUMENTS

| | | | | |
|---|---|---|---|---|
| 7,071,888 | B2 * | 7/2006 | Sievenpiper | 343/745 |
| 7,956,815 | B2 * | 6/2011 | Ohira et al. | 343/730 |
| 8,786,496 | B2 * | 7/2014 | Rida et al. | 343/700 MS |
| 2003/0160722 | A1 * | 8/2003 | Kwon et al. | 343/700 MS |

* cited by examiner

*Primary Examiner* — Dao Phan
(74) *Attorney, Agent, or Firm* — Mintz Levin Cohn Ferris Glovsky and Popeo, P.C.; Peter F. Corless; Steven M. Jensen

(57) ABSTRACT

Disclosed is a beam steering antenna structure, including two parallel metallic boards, an antenna perpendicularly disposed between the two metallic boards, a plurality of substrates perpendicularly disposed between the two metallic boards and radially disposed around the antenna, and a bias voltage circuit. Each of the substrates has a plurality of metal units cyclically aligned thereon, and each of the metal units includes two metallic regions oppositely disposed and in no contact with each other and a transistor disposed between the two metallic regions for coupling the two metallic regions. The transistors are electrically connected to the bias voltage circuit to thereby control the steering direction of beam radiation by switching the transistors.

13 Claims, 6 Drawing Sheets

BEAM STEERING ANTENNA STRUCTURE

CROSS-REFERENCE TO RELATED APPLICATIONS

This application claims under 35 U.S.C. §119(a) the benefit of Taiwanese Application No. 101107848, filed Mar. 8,2012, the entire contents of which is incorporated herein by reference.

BACKGROUND OF THE INVENTION

1. Field of the Invention

The present invention relates to antenna structures, and, more particularly, to a beam steering antenna structure.

2. Description of Related Art

The transmission paths of electromagnetic waves often encounter the blockage of large building in cities and thus result in multi-path fading. As such, presently there exist many technical improving means and the so-called Smart Antenna has become mainstream that is designed to eliminate the transmission blockage mentioned above.

Smart antennas use the characteristic of Spatial Diversity to differentiate users and signals from different locations/positions for achieving the diversity gain. In other words, Smart antennas use narrower beams for receiving and transmitting signals to obtain greater power for communication, whereas the signals transmitted within the range of non-narrow beams are suppressed by narrower beams, thus reducing the intensity of noise signals in the ambient environment to obtain a greater signal gain. To change the direction of beam transmission, Smart antennas typically use active elements to alter the type of radiation fields of electromagnetic waves, thereby achieving the spatial diversity and realizing the Spacial Division Multiple Access mechanisms which have the impact of time delay spread and multipath fading to increase transmission efficiency and coverage and thus improve the quality and quantity of communication.

Typically, the means of altering antenna beams include using mechanical scanning or phased array antenna techniques to switch the direction of beam transmission. However, the former method has the disadvantage of low speed and the latter requires a complex feed-in structure and a phase shifter in order to control the phase of each of the antenna elements and thus is costly and inconvenient to apply. Furthermore, the current technologies propose an adaptive antenna which employs the digital signal processing and the concept of array antennas, in which the direction of signals is tuned up and the direction of noise signals is tuned down to intensify the beams in the direction of signals while reducing the impact of noise signals. However, the control of beam field type requires the digital signal processing in the basic frequency and thus has higher hardware and technology demands for practical applications.

Additionally, there has been an directional antenna structure 1 that employs the Cylindrical Electromagnetic bandgap proposed by H. Boutayeb et al. published in the Periodicals IEEE Transactions on Antennas Propagation in an article "Analysis and design of a cylindrical EBG-based directive antenna." As depicted in FIG. 1, the directional antenna structure 1 is composed of an antenna 12 and multiple coil metallic wires 14 winding around the core of the antenna 12, wherein two electrodes 13 are disposed between the ring upon rings of the metallic wires 14 for the control of two electrodes 13, to either form a conductive equivalent continuous metallic wire that prevents electromagnetic waves from transmission, or to form a non-bias voltage equivalent discontinuous metallic wire for transmission, thereby controlling directions of the beam radiation. Yet, not only the processing of metallic wire is complex and laborious but also greater power consumption will be required to effectively block electromagnetic waves from spreading out.

Therefore, it is desirable and highly beneficial to provide a more effective and ideal design of the antenna structure capable of overcoming the drawbacks as encountered in prior techniques.

SUMMARY OF THE INVENTION

In view of the drawbacks associated with the prior techniques, the invention proposes a beam steering antenna structure, which comprises two parallel metallic boards, an antenna perpendicularly disposed between the two metallic boards, a plurality of substrates perpendicularly disposed between the two metallic boards and radially disposed around the peripheral of the antenna, and a bias voltage circuit. Each of the substrates has a plurality of metal units cyclically aligned thereon, and each of the metal units has two metallic regions disposed opposite to and in no contact with each other and a transistor disposed between the two metallic regions for coupling the two metallic regions. The transistors are electrically connected to the bias voltage circuit so as to be supplied with bias voltages for conducting the metallic units.

The foregoing beam steering antenna structure is operable under specific frequency ranges. For example, when the bias voltage circuit fails to provide a bias voltage to the transistors of the metallic units, the specific frequency electromagnetic waves incident to the metallic units are reflected by the metallic units; on the other hand, when the bias voltage circuit provides a bias voltage to the transistors of the metallic units, electromagnetic waves incident to the metallic units within specific frequency ranges penetrate the metallic units.

Further, the foregoing beam steering antenna structure may include a plurality of fastening portions formed in each of the metallic boards for coupling with a plurality of fasteners to fasten the substrates between the metallic boards.

Compared to prior techniques, the beam steering antenna structure of the invention has relatively lower demands for hardware as it does not require the steering of phases in every antenna element, and also its major advantage lies in its capability of effective saving of power energy since it provides bias voltages to the transistors for enabling the continuance of the metallic units only in the direction of transmission or reception of electromagnetic waves. In contrast, the conventional art employs the concept of electromagnetic gap in which the electromagnetic waves radiate toward the direction of the metallic wires containing light emitted diodes without bias voltages, and the remaining metallic wires with bias voltages form a reflective surface to block out electromagnetic waves and thus consume greater power energy as a result.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

The following illustrative embodiments are provided to illustrate the disclosure of the present invention, these and other advantages and effects can be understood by persons skilled in the art after reading the disclosure of this specification. Note that the structures, proportions, sizes depicted in the accompanying figures merely serve to illustrate the disclosure of the specification to allow for comprehensive reading without a limitation to the implementation or applications of the present invention, and does not constitute any substantial technical meaning. Also, the expressions and terms quoted in the specification including "length," "width" and "angle" are illustrative but not restrictive, and may encompass alterations or adjustments of its relative relations without substantially altering the technical contents contained therein.

Figure 1:
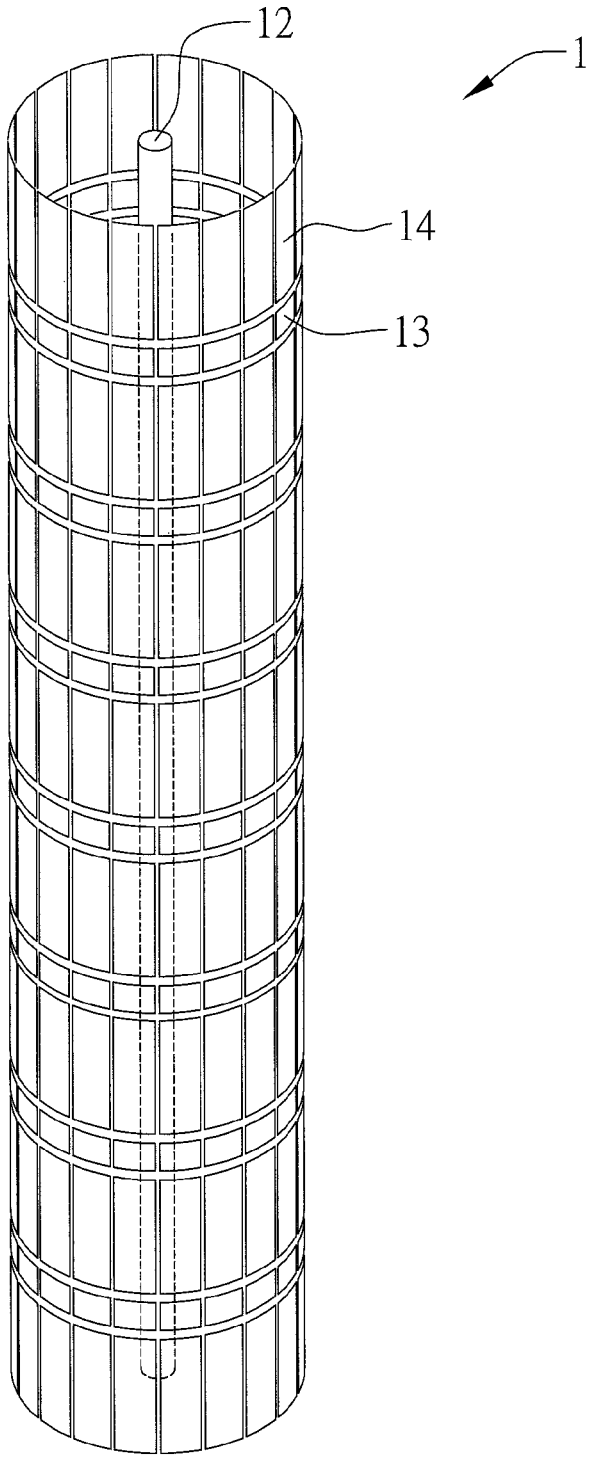
FIG. 1 (PRIOR ART)
FIG. 1 is a three-dimensional view of a conventional directional antenna structure.
Figure 2A:
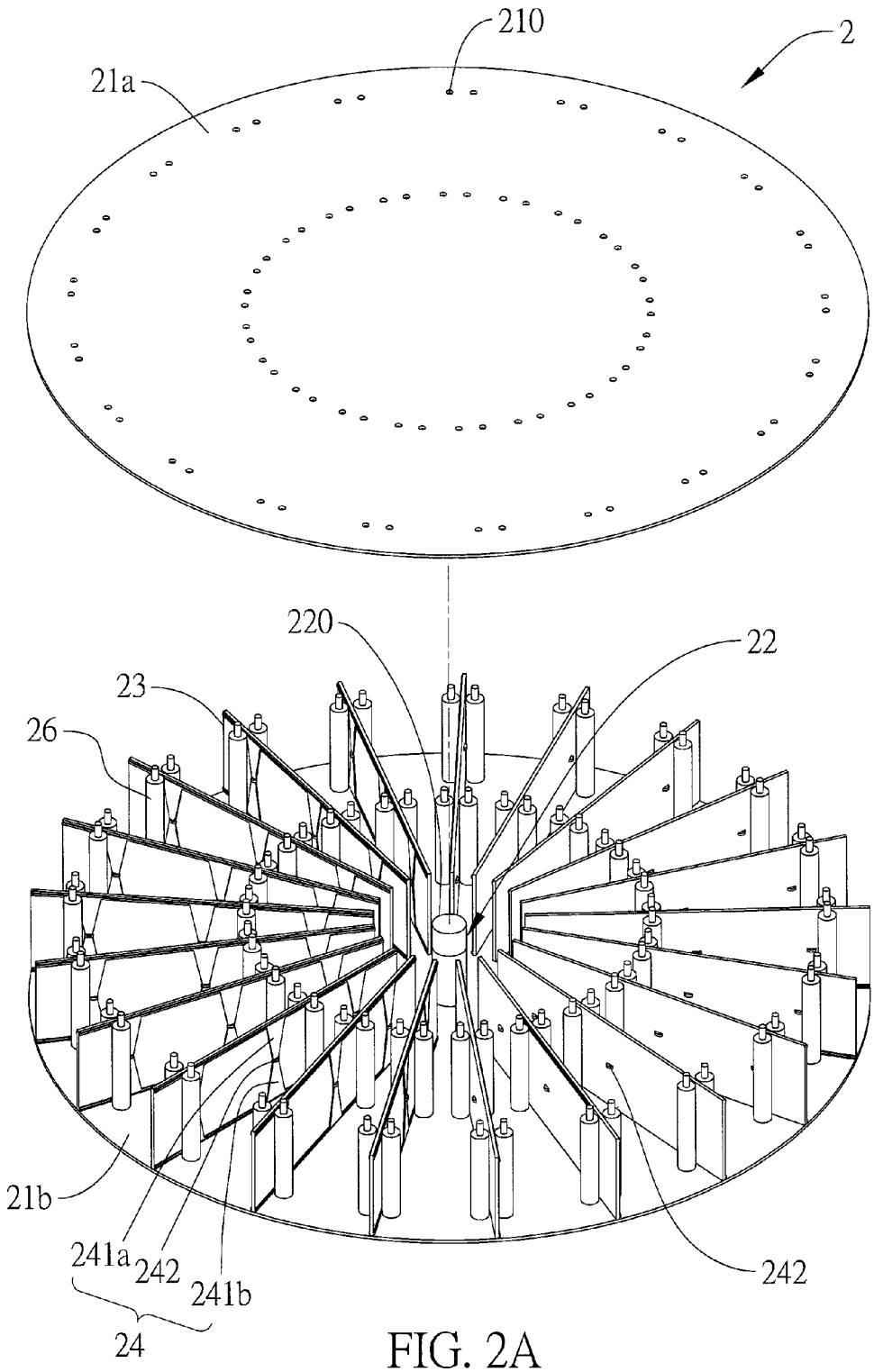
FIGS. 2A and 2B depict an exploded view and an assembly view of the beam steering antenna structure in accordance with the present invention, respectively.
Figure 2B:
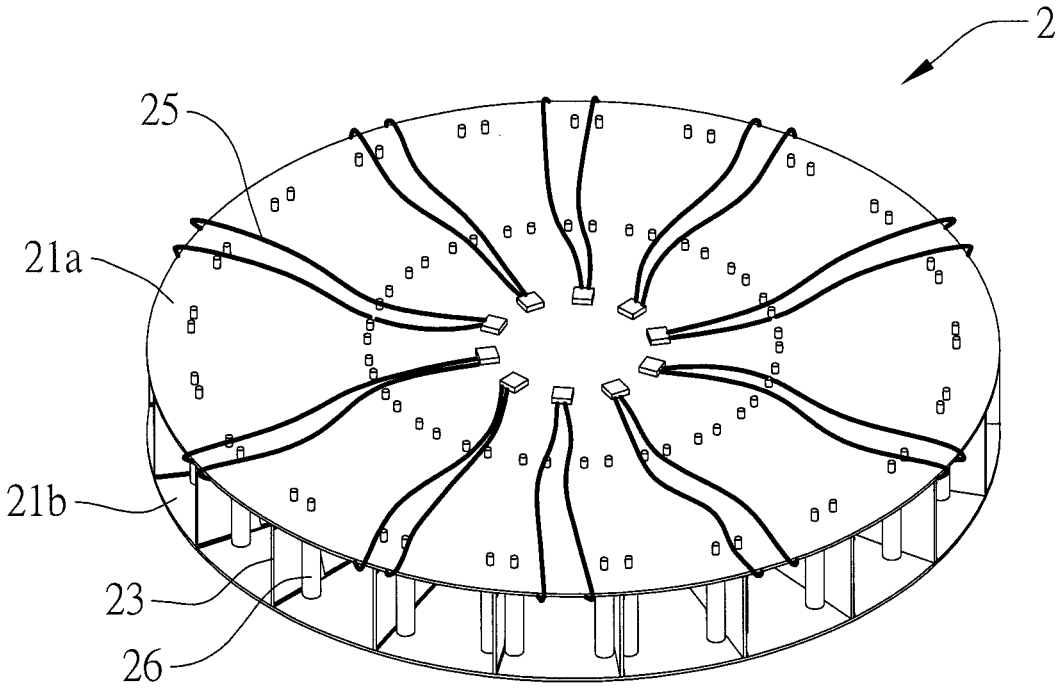

Referring to FIGS. 2A and 2B, a beam steering antenna structure 2 comprises two metallic boards 21*a* and 21*b*, an antenna 22, multiple substrates 23 and a bias voltage circuit 25. The two parallel metallic boards 21*a* and 21*b* are of round-shaped boards parallel to one another, which may comprise an aluminum round board in practical application. The antenna 22 is perpendicularly disposed between the two metallic boards 21*a*, 21*b*, and, as shown in FIG. 2A, the antenna 22 is disposed on the center of the two metallic boards 21*a*, 21*b* and is a monopole antenna on which a metallic portion 220 such as a copper post can be mounted. The resistance match of the antenna 22 may be adjusted by an alteration of the diameter and height of the copper post.

The multiple substrate 23 such as dielectric substrates are radically disposed around the antenna 22 extending towards a perpendicular direction of the antenna 22, and perpendicularly disposed between the two metallic boards 21*a*,21*b*. Each of the substrate 23 includes multiple cyclically aligned metallic units 24, each of which includes two metallic regions 241*a*241*b* that are oppositely disposed and separate from one another, wherein a transistor 242 is disposed in the two metallic regions 241*a*,241*b* for coupling the regions 241*a*, 241*b*. As illustrated in FIG. 2A, the two metallic regions 241*a*, 241*b* may include trapezoid structure with the short sides thereof being oppositely disposed to one another. The two metallic regions 241*a*, 241*b* of the trapezoid structure may be formed on the substrate 23 by means of electroplating, and the transistors 242 may be positioned between the two metallic regions 241*a*,241*b* by way of welding, such as the P-intrinsic-N (PIN) diode, and thus the metallic regions are called bowtie units.

The bias voltage circuit 25 is electrically connected to the transistors 242 for supplying bias voltages to conduct the metallic units 24. Further, multiple fasteners 26 as shown in FIG. 2A as four plastic pillars can be used to fasten a substrate 23 between the two metallic boards 21*a*, 21*b*, wherein each of the metallic boards 21*a*, 21*b*, is provided with multiple fastening portions 210 such as fastening holes, for allowing the fasteners 26 to be latched into fastening holes 210 and thus secure the substrate 23 in place. Therefore, the plurality of substrates 23 and the antenna 22 are radially sandwiched between the metallic boards 21*a*, 21*b* using the center of the antenna 22 to form a cylinder, as shown in FIG. 2B.

In the beam steering antenna structure 2, the metallic units 24 can serve as resonators, and the substrates 23 having these resonators can serve as switched waveguide walls for switching the blockage or the permeation of beams of the beam steering antenna structure 2. Where the bias voltage 25 fails to provide bias voltages to the transistors 242 interposed between two metallic regions 241*a*, 241*b* of the metallic units 24, the metallic units 24 are not continuous and electromagnetic waves laterally incident to the metallic units 24 will be reflected; conversely, where the bias voltage 25 provides bias voltages to the transistors 242 interposed between two metallic regions 241*a*, 241*b* of the metallic units 24, the metallic units 24 are continuous and electromagnetic waves laterally incident to the metallic units 24 will be permeating.

Figure 3A:
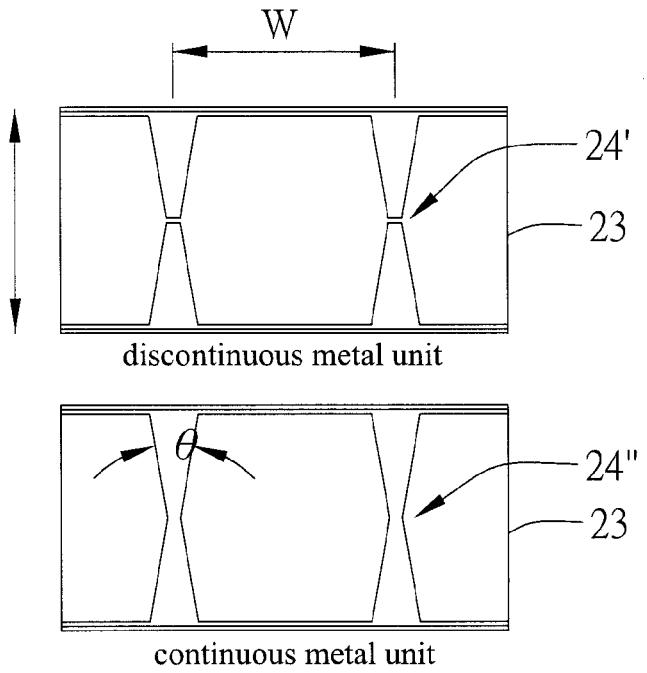
FIG. 3A illustrates a schematic view of the continuous and the discontinuous metallic units of the beam steering antenna structure according to the present invention.
Figure 3B:
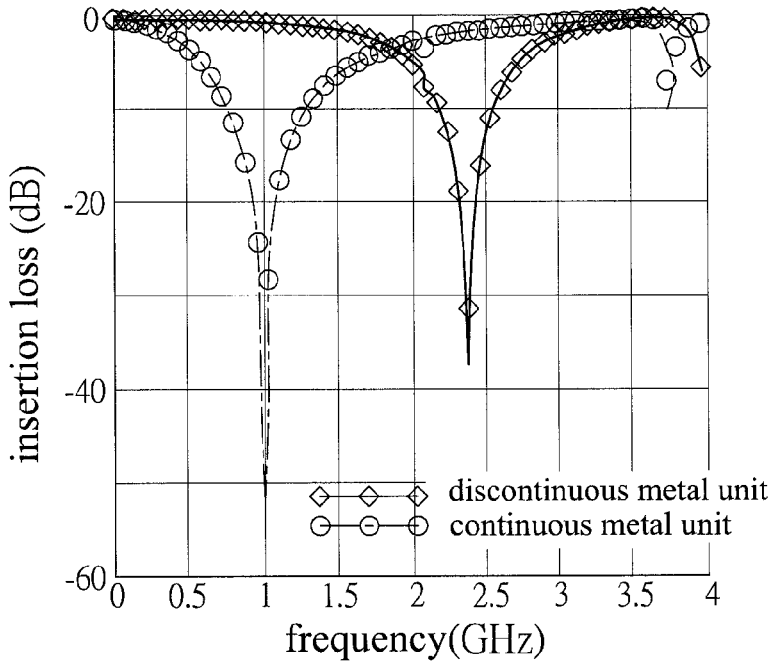
FIG. 3B depicts the penetrating and reflective properties of electromagnetic waves under specific frequency ranges with respect to the continuous and discontinuous metallic units of the beam steering antenna structure according to the present invention.

FIGS. 3A and 3B indicate the permeating and reflective characteristics of the laterally emitted electromagnetic waves with respect to the discontinuous and the continuous metallic units under specific frequency ranges.

FIG. 3A shows that the metallic units 24' or 24" have periods W, lengths L and opening angles 0. As shown in FIG. 3B, when the metallic units are discontinuous 24', electromagnetic waves at a specific frequency range (e.g., 2.4 GHz) will not be able to penetrate the discontinuous metallic units 24', wherein its insertion loss is −31 dB and similar to a total reflection; when the metallic units are continuous 24" electromagnetic waves at the same frequency range (e.g., 2.4 GHz) will be able to penetrate the continuous metallic units 24", wherein its insertion loss is −1.5 dB and similar to a total permeation.

Further, the experiments show that when metallic units are discontinuous 24', the greater the periods W or lengths L are, the lower frequency ranges to which the non-permeable electromagnetic waves will move; the larger the opening angle of the metallic regions of the metallic units, the higher frequency ranges to which the non-permeable electromagnetic waves will move. On the other hand, when the metallic units are continuous, the greater the periods W of the metallic units are, the lower frequency ranges to which the permeable electromagnetic waves will move while the length L thereof does not impact much; the larger the opening angles of the metallic regions of the metallic units, the higher frequency ranges to which the permeable electromagnetic waves will move.

Accordingly, the alterations of the periods W, lengths L and opening angles 0 of the metallic units 24' or 24" of the substrate 23 may decide whether the substrate 23 would exhibit the permeating or reflective characteristics with respect to the laterally emitted electromagnetic waves under specific frequency ranges.

Also, the reflective coefficient of the beam steering antenna structure may be affected by various factors including the width, length, thickness and quantity of the substrate, the diameter and the height of the beam steering antenna structure and the metallic units disposed on the monopole antenna, and the center of the antenna including the distance of the discontinuous metallic units to edges of the substrate.

Figure 4A:
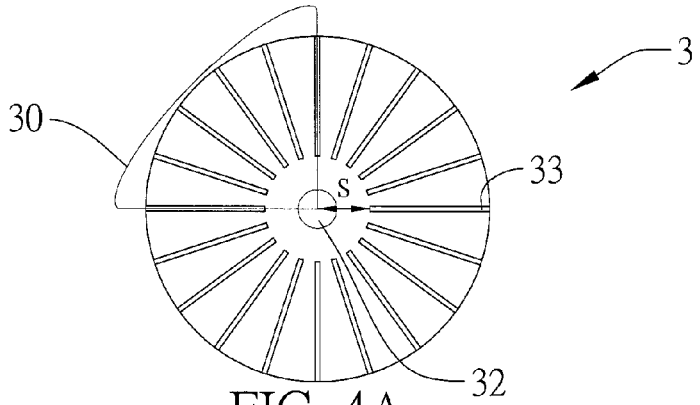
FIG. 4A illustrates a preferred embodiment of the transistors disposed on the substrate of the beam steering antenna structure being guided through by bias voltages.
Figure 4B:
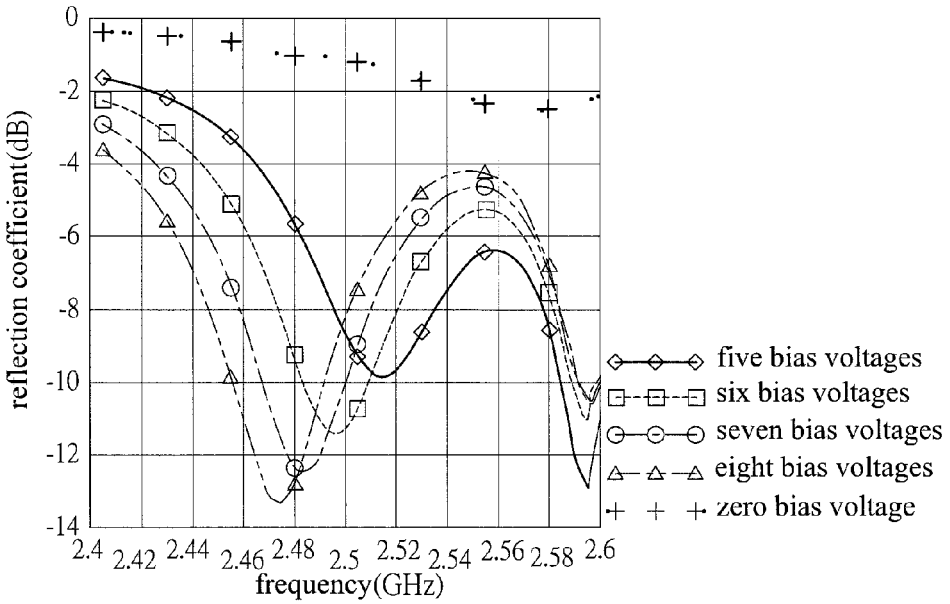
FIG. 4B illustrates a preferred embodiment of the reflective coefficient of guiding through various quantities of substrates on the beam steering antenna structure according to the present invention.
Figure 4C:
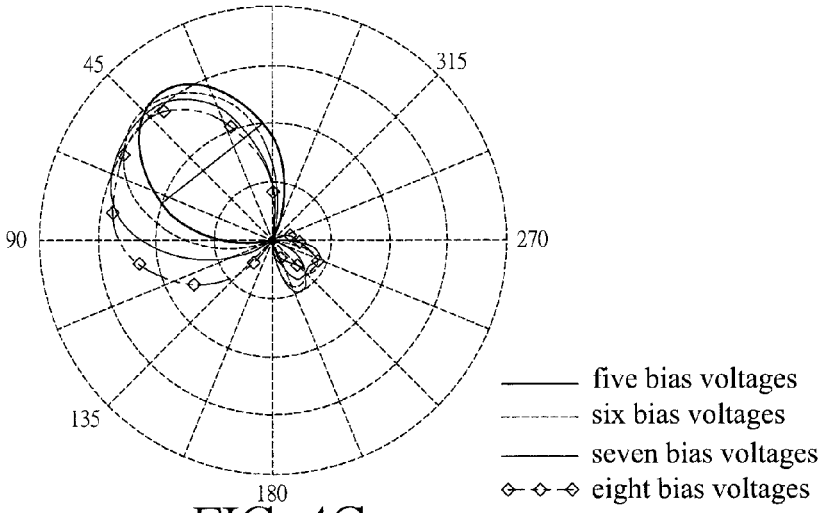
FIG. 4C illustrates a view of the type of the radiation field of the antenna structure depicted in FIG. 4A.

For instance, FIG. 4 illustrates a transistor mounted on the substrate 33 of a beam steering structure 3 being conducted by bias voltages, wherein the fan-shaped region 30 is the region where the transistor supplied with a bias voltage can be permeated by electromagnetic waves, and S represents the distance of the center of the antenna 32 and edges of the substrate having transistors without the bias voltage. The experiments discovered that when the distance S becomes greater, the reflective coefficient of the beam steering antenna structure 3 tends to move toward a lower frequency range. FIG. 4B depicts the reflective coefficients of the beam steering antenna structure having different quantities of substrates being conducted by bias voltages. As shown, when the substrates are not supplied with bias voltages, that is when the transistors are in an off state, the reflective coefficient within the frequency range 2.57 GHz is −2.5 db is smallest; when more substrates are supplied with bias voltages, the center frequency of the reflective coefficient tend to move gradually toward lower frequency ranges, and when under −6 dB bandwidth the frequency range is almost maintained at 80 MHz or so. FIG. 4C illustrates a radiation field type in which it was discovered that the greater number of the substrates having bias voltages, the wider of the half power beam width becomes.

Accordingly, it is apparent that in the reflective coefficient of the beam steering antenna structure, the parameters including the width, length, thickness and quantity of the substrate, the periods, lengths and opening angles of the metallic units mounted on the substrates, the diameter and the height of the beam steering antenna structure and the metallic units disposed on the monopole antenna, and the center of the antenna including the distance of the discontinuous metallic units to edges of the substrate are all influencing factors of the operating frequency ranges of the beam steering antenna structure.

Figure 5A:
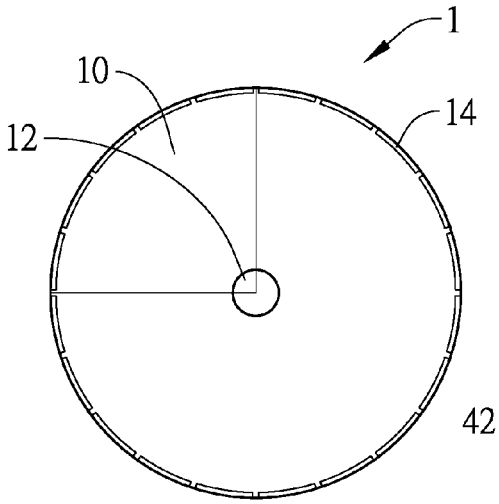
FIG. 5A(PRIOR ART)
FIGS. 5A and 5B illustrate a conventional directional antenna structure and the type of its radiation field.
Figure 5C:
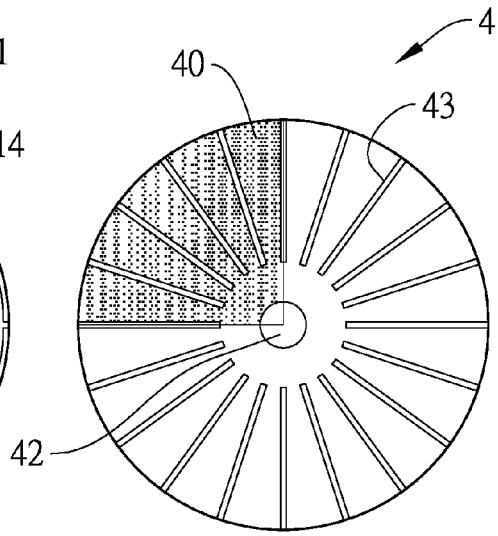
FIGS. 5C and 5D illustrate the beam steering antenna structure and the type of its radiation field in accordance with the present invention.
Figure 5B:
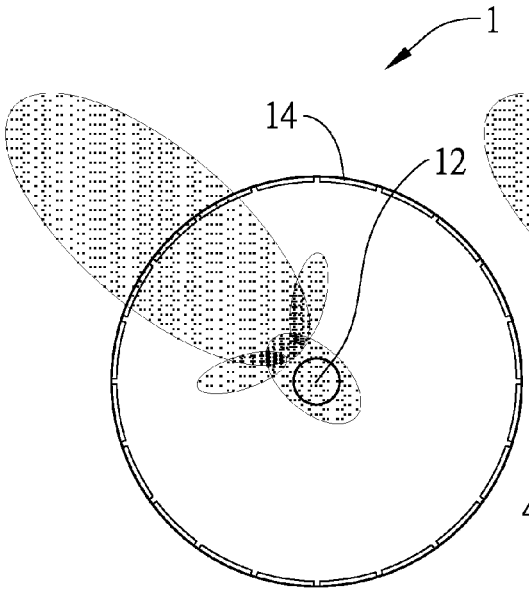
FIG. 5B (PRIOR ART)
Figure 5D:
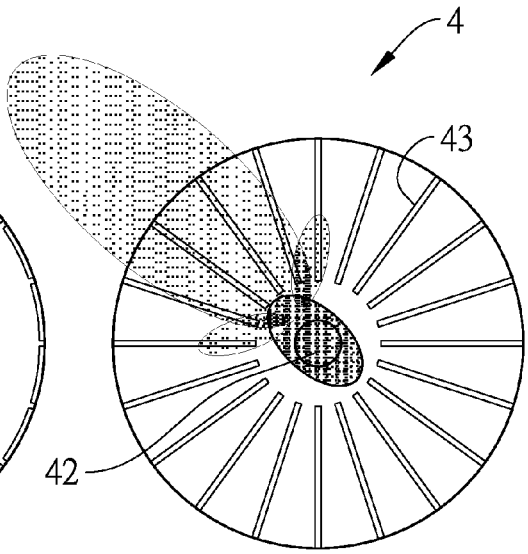

Next, FIGS. 5A to 5D illustrate the comparisons of the beam steering antenna structure of the invention with the conventional directional antenna structure. The directional antenna structure 1 shown in FIG. 5A employs the concept of electromagnetic energy gap in which electromagnetic waves radiate from the direction of the metallic wires of light emitted diodes having no bias voltages, while the remaining metallic wires of emitted diodes with bias voltages form a reflective surface to block out electromagnetic waves. As shown, only parts of the emitted diodes between the metallic wires 14 are not supplied with bias voltages, i.e. the fan-shaped region 10 from which electromagnetic waves can be transmitted or received, thus consuming relatively greater energy in order to steer the direction of radiation, and FIG. 5B illustrates a radiation field type of the directional antenna depicted in FIG. 5A. Further, FIG. 5C depicts a beam steering antenna structure 4 of the present invention in which only the transistors on parts of the substrates 43 are supplied with bias voltages, i.e. the fan-shaped region 40 from which electromagnetic waves are transmitted or received, and FIG. 5D indicates a radiation field type of the directional antenna structure 4 depicted in FIG. 5C. Therefore, it is evident that the present invention has advantages over the prior art as it consumes less power energy than prior techniques.

In addition, the beam steering antenna structure enables electromagnetic waves to laterally emit into each of the switched waveguide walls (i.e. the foregoing substrates), thus requiring fewer substrates and transistors than prior techniques with a more compact size yet capable of achieving the same steering effect of beam radiation.

Summarizing the above, the invention is characterized by disposing multiple substrates serving as switched waveguide walls on the peripheral of the monopole antenna structure, and the substrates are provided with cyclically aligned metallic units serving as resonators, such that the transistors mounted on the switched waveguide walls can be controlled to be supplied with bias voltages or not to achieve the switch of the total-reflective or total-permeation characteristics of electromagnetic waves with respect to switched waveguide walls under specific frequency ranges, and thus the laterally remitted electromagnetic waves can be blockaded or permeated through to turn light beams on the same specific plane surface, and by controlling the type of the radiation fields of antenna structures, light beams can be radiated from an intended direction for transmission or reception. Compared to prior techniques of array or directional antenna structures, the beam steering antenna structure of the present invention significantly simplifies the structural complexity and also achieves energy-saving and thus is more applicable to the wireless communications industry.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A beam steering antenna structure, comprising two parallel metallic boards;

an antenna structure perpendicularly disposed between the two metallic boards;

a plurality of substrates perpendicularly disposed between the two metallic boards and radially disposed around a peripheral of the antenna structure, wherein each of the substrates has a plurality of metal units cyclically aligned thereon, and each of the metal units has two metallic regions disposed opposite to and in no contact with each other and a transistor disposed between the two metallic regions for coupling the two metallic regions; and a bias voltage circuit electrically connected to the transistors for supplying bias voltages to and conduct the metallic units.

2. The beam steering antenna structure claimed in claim 1, wherein when the bias voltage circuit does not provide bias voltages to the transistors of the metal units, electromagnetic waves incident to the metallic units are reflected by the metallic units.

3. The beam steering antenna structure claimed in claim 1, wherein when the bias voltage circuit provides bias voltages to the transistors of the metal units, the electromagnetic waves incident to the metallic units are permeable through the metallic units.

4. The beam steering antenna structure claimed in claim 1, wherein the antenna is a monopole antenna and has a metallic portion.

5. The beam steering antenna structure claimed in claim 4, wherein the metallic portion of the monopole antenna comprises copper pillars.

6. The beam steering antenna structure claimed in claim 1, wherein the substrates are dielectric substrates.

7. The beam steering antenna structure claimed in claim 1, wherein the metallic regions are in a shape of a trapezoid and are connected to each other with short sides of the trapezoids.

8. The beam steering antenna structure claimed in claim 1, wherein the metallic boards are round-shaped boards, and the antenna is disposed at the center of the two metallic boards.

9. The beam steering antenna structure claimed in claim 1, wherein the metallic boards are aluminum boards.

10. The beam steering antenna structure claimed in claim 1, further comprising a plurality of fasteners, and each of metallic boards is provided with a plurality of corresponding fastening portions, for allowing the fasteners to be coupled to the fastening portions to secure the substrates between the two metallic boards.

11. The beam steering antenna structure claimed in claim 10, wherein the fasteners are plastic pillars.

12. The beam steering antenna structure claimed in claim 1, which has an operating frequency range determined by size and quantity of the substrates, and shape, size and cyclically alignment of the metallic units mounted on the substrates.

13. The beam steering antenna structure claimed in claim 12, wherein the operating frequency range of the beam steering antenna structure is 2.4 GHz.

* * * * *